US008342876B2

(12) United States Patent
Lee et al.

(10) Patent No.: US 8,342,876 B2
(45) Date of Patent: Jan. 1, 2013

(54) ELECTRICAL SOCKET WITH A GUIDE TO URGE A LEAD OF AN ELECTRICAL COMPONENT TO A TERMINAL

(75) Inventors: Davin Robert Lee, Watertown, WI (US); Miguel Angel Perez, Manati, PR (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 13/113,381

(22) Filed: May 23, 2011

(65) Prior Publication Data

US 2012/0302087 A1 Nov. 29, 2012

(51) Int. Cl.
*H01R 13/64* (2006.01)

(52) U.S. Cl. ..... 439/377

(58) Field of Classification Search ..... 439/377, 439/680, 719

See application file for complete search history.

(56) References Cited

U.S. PATENT DOCUMENTS

| | | | | |
|---|---|---|---|---|
| 4,303,297 | A | 12/1981 | Smart et al. | |
| 4,631,377 | A | 12/1986 | Imazeki et al. | |
| 4,702,706 | A | 10/1987 | Sadigh-Behzadi | |
| 4,911,662 | A * | 3/1990 | Debortoli et al. | 439/719 |
| 5,053,591 | A * | 10/1991 | Theurer | 200/315 |
| 5,417,400 | A * | 5/1995 | Arakawa | 248/323 |
| 5,605,395 | A | 2/1997 | Peng | |
| 6,238,251 | B1 * | 5/2001 | Curtis et al. | 439/680 |
| 6,270,355 | B1 | 8/2001 | Kihara | |
| 6,409,530 | B1 | 6/2002 | Zhao et al. | |
| 7,105,762 | B1 * | 9/2006 | Lee | 200/449 |
| 7,201,081 | B2 * | 4/2007 | Mossler | 74/502.4 |
| 7,731,396 | B2 | 6/2010 | Fay et al. | |
| 2009/0080195 | A1 | 3/2009 | Huang | |
| 2010/0067242 | A1 | 3/2010 | Fung | |
| 2010/0258418 | A1 | 10/2010 | Yu | |

FOREIGN PATENT DOCUMENTS

FR 2 838 811 A3 10/2003

OTHER PUBLICATIONS

Patent Cooperation Treaty (PCT) International Search Report and Written Opinion from copending PCT International Application No. PCT/US2012/038936 (International Filing Date of May 22, 2012) having a date of mailing of Aug. 20, 2012 (11 pgs).

* cited by examiner

*Primary Examiner* — Chandrika Prasad

(57) ABSTRACT

A leaded device socket includes a lead guide that contacts and urges the leads on an electrical component into the correct position in the device when the component is pressed into the socket. The leaded device socket may also include a receiver for retaining a functional portion of the electrical component in a predetermined position in the circuit. The lead guide and receiver may both be integrally molded with the socket.

17 Claims, 5 Drawing Sheets

ELECTRICAL SOCKET WITH A GUIDE TO URGE A LEAD OF AN ELECTRICAL COMPONENT TO A TERMINAL

BACKGROUND

Standard electrical components are typically provided with leads with which they can be electrically connected in a circuit. The leads may be soldered or crimped to wires or traces to install the component in a circuit. As circuits are made smaller, space for installation of components is limited. This may require separate mounting components or additional manufacturing operations to manipulate the leads for connection in a crowded circuit. To shrink the amount of space required for installing a component, a component's leads may be customized for a particular circuit. Another space-saving technique is to use crimped connections instead of soldered connections. Of course, customized leads and crimp connectors multiply part numbers and increase component cost.

BRIEF DESCRIPTION OF THE DRAWINGS

The accompanying drawings, which are incorporated in and constitute a part of the specification, illustrate various systems, methods, and other embodiments of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

DETAILED DESCRIPTION

The leaded component socket and assembly methods described herein provide a low cost way to assemble, mount, and electrically connect an electrical component in a device. By way of example, a leaded LED used for lighting in a rocker switch is connected by its leads to terminals or other electrical components in the switch. Using state-of-the-art techniques, if the LED has a standard configuration with straight leads, the leads are manually formed and positioned during assembly. In some instances, the LED is purchased with preformed leads specifically designed to contact the terminals when the LED is installed. Often a separate component is used to retain the LED and its leads in the correct position within the device.

The leaded component socket described herein includes lead guides that contact and urge standard configuration leads on an electrical component (e.g., an LED) into the correct position within a device when the component is pressed into the socket. This eliminates the need for specially shaped leads. In some embodiments, the leaded device socket also includes a receiver for retaining the LED in the correct position in the device. Thus, a separate retaining component may not be necessary. The receiver may also include integral features for supporting an o-ring used to seal around the leaded electrical component. In some embodiments, the lead guides and receiver are integrally molded with the socket.

Figure 1:
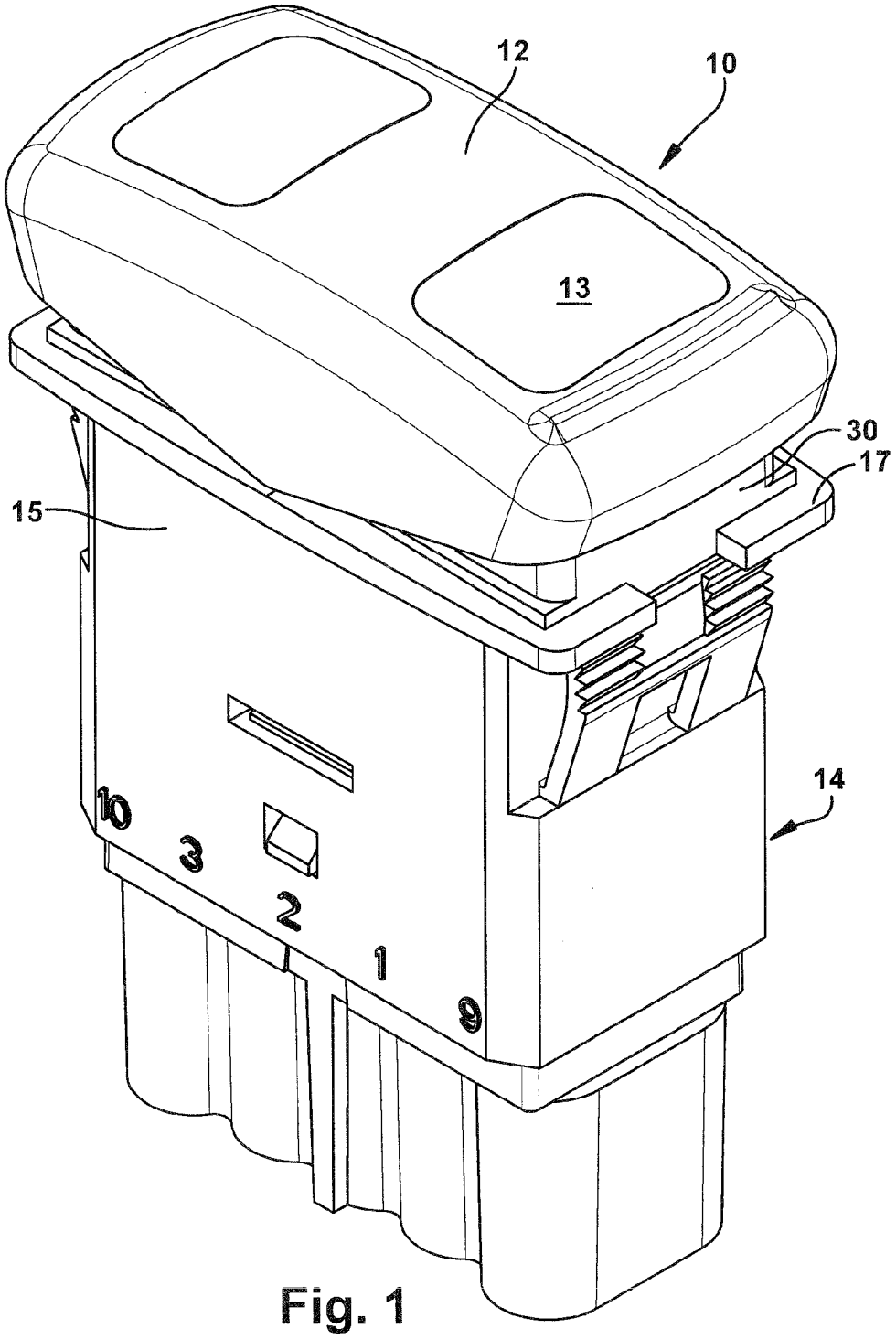
FIG. 1 is a perspective view of a rocker switch that includes a leaded component socket constructed in accordance with one embodiment of the present invention.

FIG. 1 illustrates a rocker switch 10 that contains a leaded component socket in constructed in accordance with one embodiment of the present invention. The rocker switch 10 includes a user-actuable rocker 12 that is moveable relative to a switch body 15 to select functions in a vehicle. As will be described in more detail below, one or more LEDs may be housed within the rocker switch 10 to enhance the visibility of the rocker 12 and in some cases to illuminate feature descriptors imprinted on the rocker 12. For example, the rocker may include one or more translucent panels 13 that are illuminated by an LED.

Figure 1A:
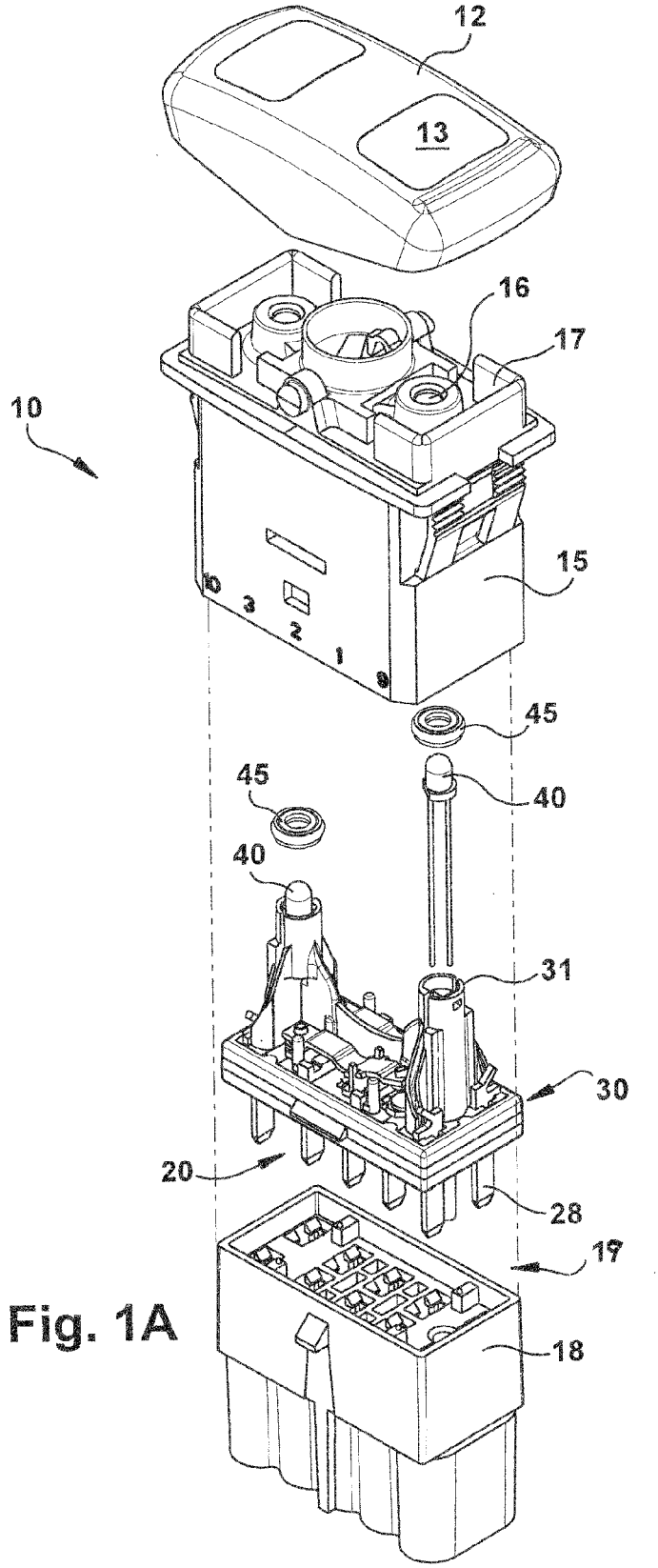
FIG. 1A is an exploded view of the rocker switch of FIG. 1.

FIG. 1A is an exploded view of the rocker switch 10. The main components of the switch 10 include the rocker 12, the switch body 15, a socket assembly, and a plug portion 18 having a circuit 19. The socket assembly 30 serves as mechanical mounting point for two LEDs 40 and also includes electrical connections between the rocker switch and a plurality of electrical terminals 20. The electrical terminals 20 are pressed into the plug portion 18, where a mating electrical connector (not shown) is used to electrically connect the rocker switch 10 to a wiring harness.

The socket assembly 30 is housed within the switch body 15. The switch body 15 includes features that allow the rocker switch 10 to be mounted in a vehicle trim panel. The switch frame 15 also includes a face portion 17 that supports the rocker 12 and includes two LED locator features 16. The LED locator features 16 are sized to closely surround the LED 40 and also to squeeze an o-ring 45 between an underside of each locator feature 16 and an o-ring rim 31 on the socket assembly. This helps keep moisture out of the socket assembly 30, where it may corrode electrical connections. In some embodiments, the o-ring may not be used, however, the same socket assembly 30 can be used in either case.

Figure 2:
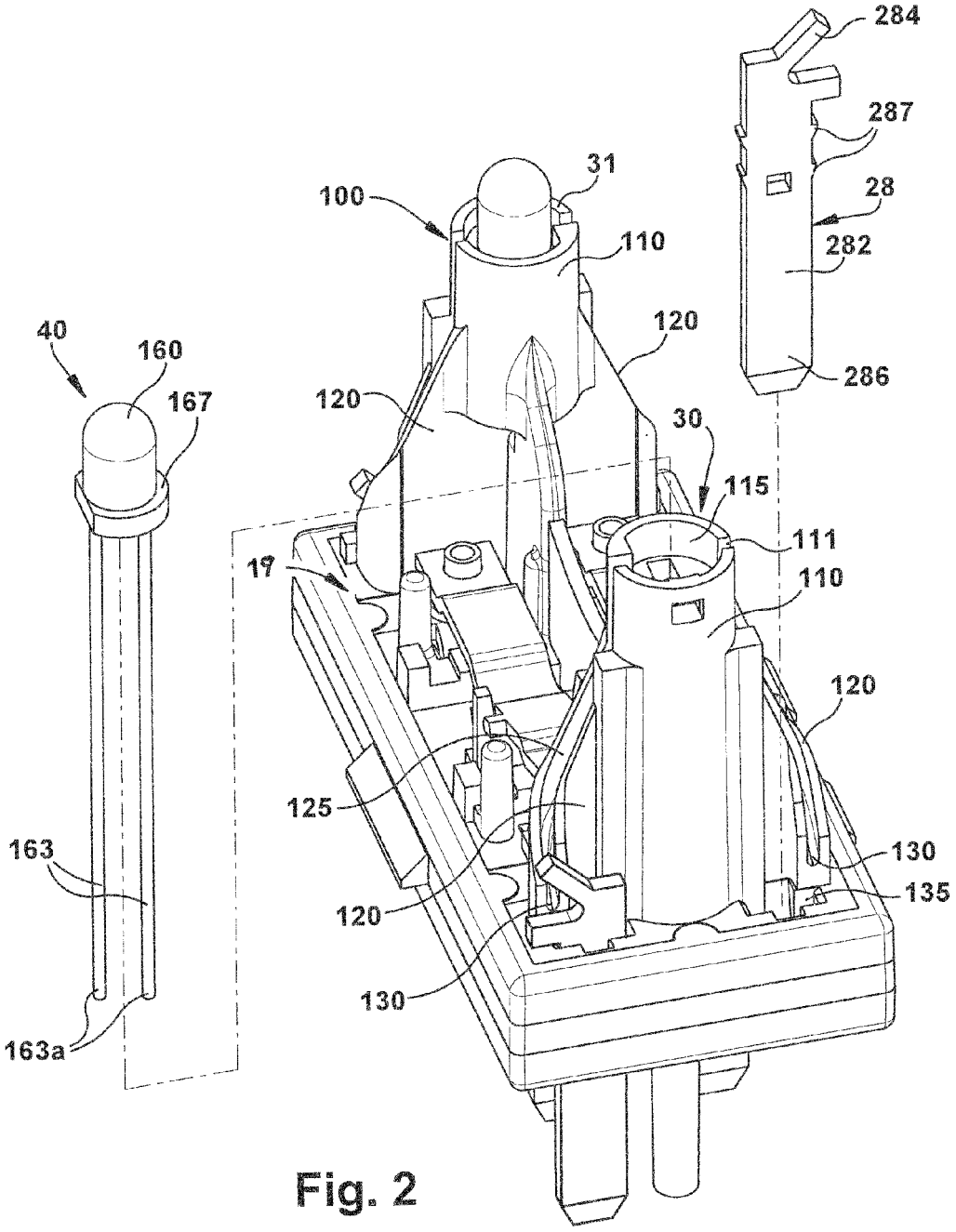
FIG. 2 is a perspective view of a leaded component socket constructed in accordance with one embodiment of the present invention.

FIG. 2 illustrates, in more detail, the example embodiment of a socket assembly 30 shown in FIG. 1. The socket assembly 30 includes a molded socket base 100 that includes two sockets 110, each of which serves as a mounting point for an LED 40. Each socket 110 includes a receiver 115 and two lead guides 120, one for each lead 163 of the LED 40. The receiver 115 is generally cup shaped to receive a functional portion 160 of the LED and to retain the functional portion 160 in place within the rocker switch. The receiver includes an o-ring rim 31 to support an o-ring 45 (FIG. 1B) installed to seal around the functional portion 160.

The lead guide 120 includes a channel 125 that defines a curvilinear path between the receiver 115 and a connection point 130. The connection point 130 defines generally where an end of an LED lead 163*a* will be positioned when the LED is installed in the socket 110. The socket base 100 includes a crimp terminal mounting slot 135 into which a lamp terminal 28 is pressed. The lamp terminal 28 includes a blade portion 282 sized to pass through the mounting slot 135 and a tapered end 286 to facilitate insertion. The lamp terminal 28 is retained within the mounting slot 135 with barbs 287 that provide frictional engagement with the slot. A crimp connector 284 is located at a head of the lamp terminal. When the lamp terminal 28 is installed in the socket base 100, the crimp connector is positioned at the connection point 130. As can be seen from FIG. 2, the receiver 115 and lead guides 120 can be integrally molded as part of the socket base 110, reducing part complexity and cost.

Figure 3:
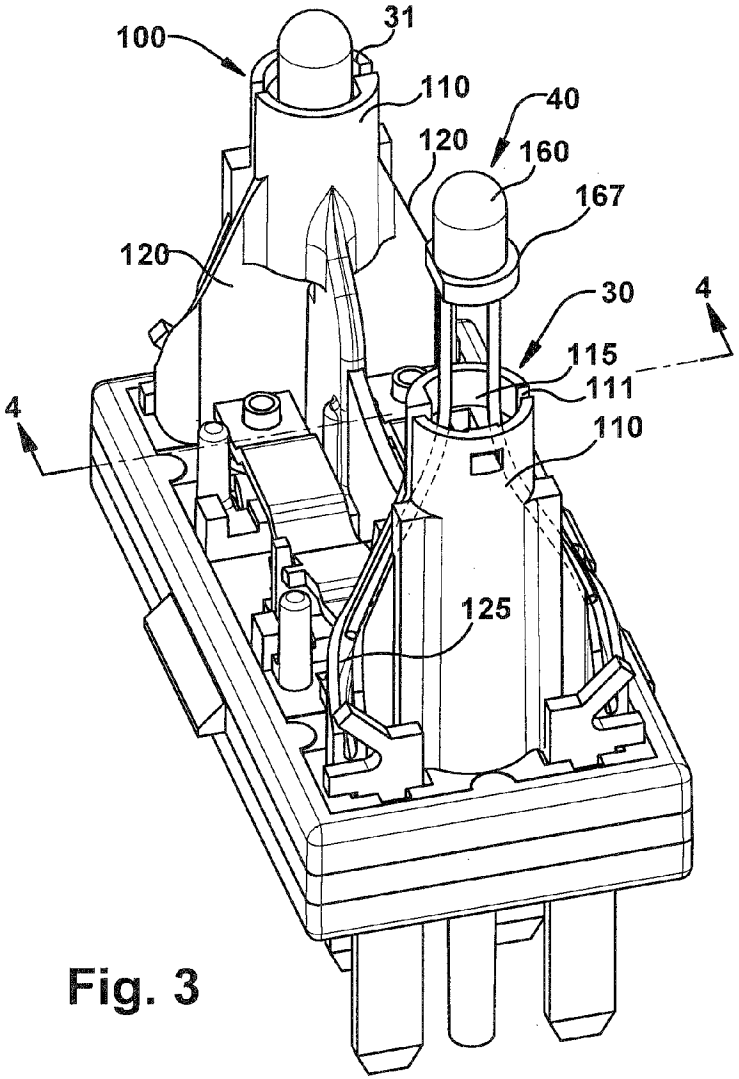
FIG. 3 is a perspective view of the leaded component socket of FIG. 2 during installation of an LED.

FIG. 3 illustrates the LED 40 partially installed in the socket 110. During installation, the LED 40 is pushed "down" in the direction indicated by the arrow.

Ends 163*a* of the leads 163 have been inserted in the receiver 115. The slots 111 lead to a channel 125 that serves as the lead guide 120. The channel 125 is sized to loosely enclose the lead 163 and defines a curvilinear, downward sloping deformation path for the lead. The deformation path can be considered to be "obtuse", because it curves gently, without acute angles. This gentle curving facilitates sliding of the lead 163 within the channel 125 and tends to prevent the end 163*a* from lodging in the channel 125 during insertion. Downward motion of the LED 40 causes the lead 163 to contact the channel and deform to fit the channel 125.

Figure 4:
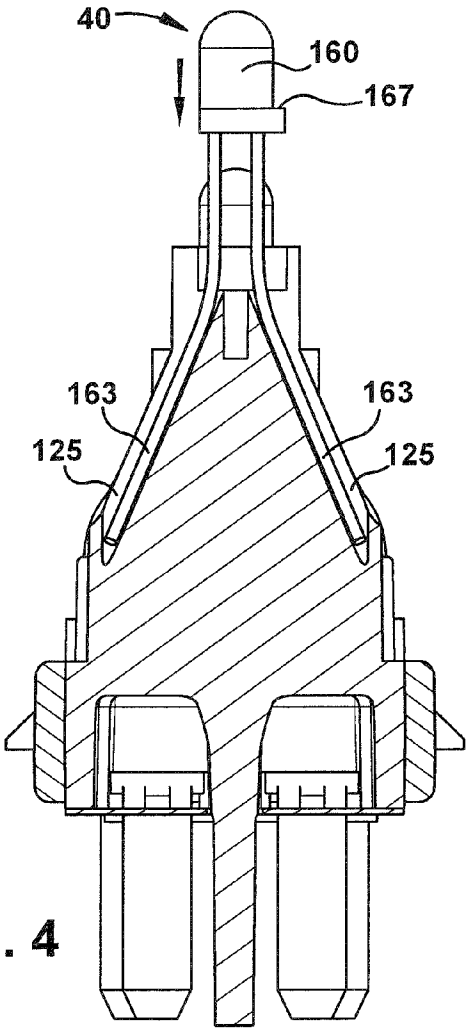
FIG. 4 is a cross section view of the leaded component socket of FIG. 3.

While two channels 125 are shown per socket 110, any number of channels 125 can be used to correspond to the number of leads on an electrical component. Modifications to the configuration of the channel 125 may be made to define a deformation path that suits a particular device configuration. FIG. 4 is a cross section of the socket 110 with the LED partially installed as shown in FIG. 3. The leads 163 rest within the channels 125 and are being deformed by the channels so that the ends will be positioned with the crimp connectors 284 (FIG. 5).

Figure 5:
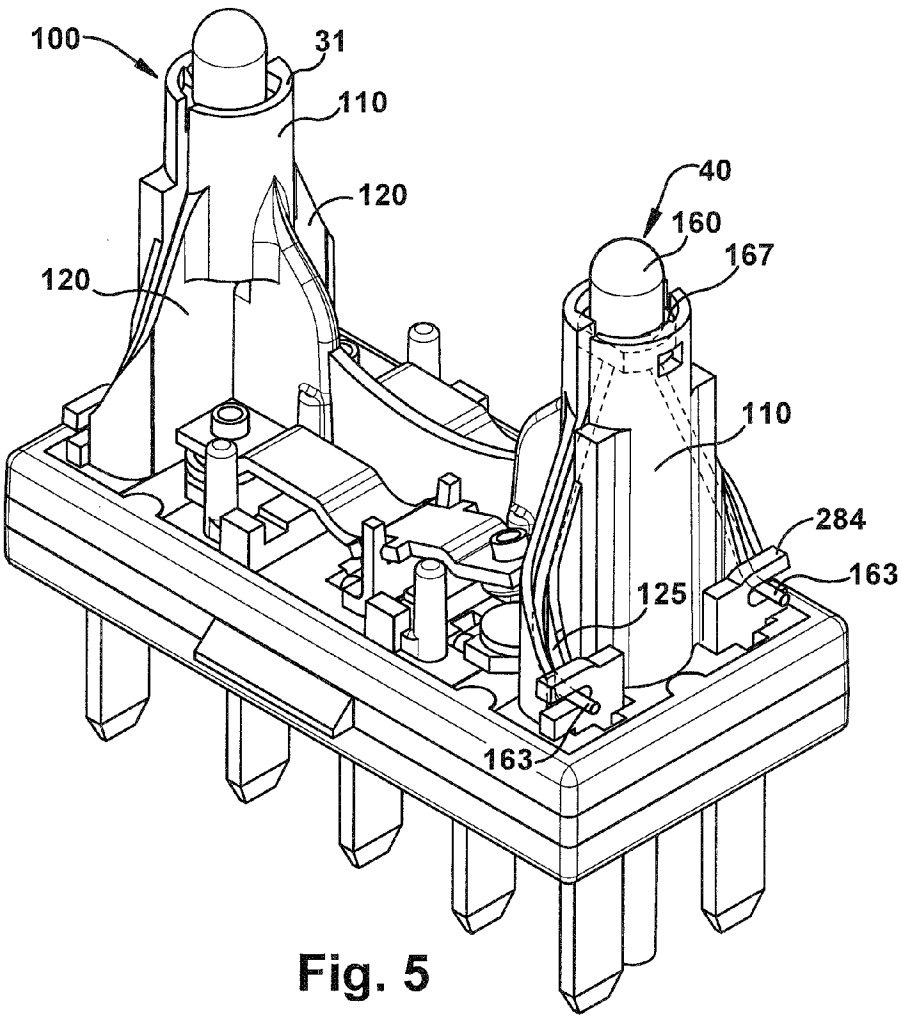
FIG. 5 is a perspective view of the leaded component socket of FIG. 2A with the LED installed.

FIG. 5 illustrates the LED 40 fully installed in the socket 110. The functional portion 160 is seated in the receiver 115 in the final assembled position. The lead ends 163*a* are positioned at the connection point within the crimp connectors 284 so that a simple crimping operation will electrically connect the LED 40 to the lamp terminal 28. As can be seen from the foregoing description, the socket 110 with integral lead guides 120 allows easy installation and connection of an LED (or other electrical component). The leads 163 of the LED can be routed to a connection point 130 without manual manipulation, facilitating assembly. The socket 110 includes both lead routing features and retention for the LED, reducing part numbers. The rim 31 can support an o-ring, if one is installed, without modification to the socket 110.

References to "one embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in one embodiment" does not necessarily refer, to the same embodiment, though it may.

While example systems, methods, and so on have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on described herein. Therefore, the disclosure is not limited to the specific details, the representative apparatus, and illustrative examples shown and described. Thus, this application is intended to embrace alterations, modifications, and variations that fall within the scope of the appended claims.

To the extent that the term "includes" or "including" is employed in the detailed description or the claims, it is intended to be inclusive in a manner similar to the term "comprising" as that term is interpreted when employed as a transitional word in a claim.

We claim:

1. An electrical component socket for mounting an electrical component in a circuit, wherein the electrical component includes a functional portion electrically connected to at least one lead, the socket comprising:

a receiver configured to support the functional portion in a predetermined position within the circuit;

at least one lead guide that defines a deformation path for the at least one lead, where a first end of the at least one lead guide is proximate to the receiver;

a terminal mounting slot disposed at a second end of the at least one lead guide and configured to retain a terminal configured to connect the electrical component to the circuit; and wherein upon insertion of the electrical component into the electrical component socket, the lead guide contacts the lead and urges the lead proximate to the terminal mounting slot.

2. The electrical component socket of claim 1 wherein the terminal mounting slot is configured to retain a crimp connector.

3. The electrical component socket of claim 1 wherein the lead guide comprises a channel configured to partially surround the lead, the lead guide further comprising a guide surface that contacts the lead.

4. The electrical component socket of claim 1 wherein the deformation path is curvilinear and slopes downward from the receiver.

5. The electrical component socket of claim 4 wherein when the lead is installed in the lead guide, the lead is curved without acute angles.

6. The electrical component socket of claim 1 wherein the receiver comprises a generally circular planar surface configured to support an underside of an LED, the receiver further comprising an o-ring groove in the circular planar surface configured to retain an o-ring to seal around the LED.

7. The electrical component socket of claim 1 wherein the receiver and lead guide are integrally molded with the socket.

8. The electrical component socket of claim 1 wherein:

the receiver comprises means for supporting the functional portion in the predetermined position within the circuit; and the at least one lead guide comprises means for contacting and urging the lead to the connection point.

9. A method of installing an electrical component in a socket, wherein the electrical component comprises a functional portion and at least one lead electrically connected to the functional portion, the method comprising:

inserting the lead into a lead guide on the socket until the lead guide contacts the lead;

installing the functional portion in a receiver, wherein movement of the functional portion into the receiver during installation causes further insertion of the lead into the lead guide, the lead guide urging, by contact, the lead along a lead deformation path to a connection point; and electrically connecting the lead to another electrical component proximate the connection point.

10. The method of claim 9 comprising crimping an end portion of the lead in a crimp connector located proximate the connection point.

11. The method of claim 9 comprising seating the functional portion in the receiver.

12. The method of claim 9 comprising installing an o-ring in the receiver, wherein the receiver contacts the o-ring to position the o-ring in a sealing position with respect to the functional portion.

13. The method of claim 9 wherein the inserting and installing results in a deformed lead that is curved without any acute angles.

14. An apparatus comprising:

a molded socket configured to retain an electrical component in a desired position in a device;

a receiver integrally molded with the socket, the receiver shaped to closely hold a functional portion of the electrical component to retain the functional component in a predetermined final position in a device; and at least one guide channel integrally molded with the socket, the at least one guide channel defining an obtuse curvilinear deformation path from the receiver to a connection point; the at least one guide channel configured to urge, by contact, a lead of the electrical component along the lead deformation path to the connection point when the electrical component is installed in the socket.

15. The apparatus of claim 14 wherein the receiver comprises an o-ring mounting feature integrally molded with the socket configured to contact the o-ring to position the o-ring in a sealing position with respect to the functional portion.

16. The apparatus of claim 14 wherein the at least one lead guide comprises a channel configured to partially surround a lead, the lead guide further comprising a guide surface that contacts the lead.

17. The apparatus of claim 14 wherein the receiver comprises a generally circular planar surface configured to support an underside of an LED, the receiver further comprising an o-ring groove in the circular planar surface configured to retain an o-ring to seal around the LED.

* * * * *